US010605056B2

(12) United States Patent
Hartley

(10) Patent No.: US 10,605,056 B2
(45) Date of Patent: Mar. 31, 2020

(54) SYSTEM FOR INSTALLING AN ELECTRICALLY SUBMERSIBLE PUMP ON A WELL

(71) Applicant: FMC Technologies, Inc., Houston, TX (US)

(72) Inventor: Howard J. Hartley, Tomball, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/314,257

(22) PCT Filed: Jul. 13, 2016

(86) PCT No.: PCT/US2016/041970
§ 371 (c)(1),
(2) Date: Dec. 28, 2018

(87) PCT Pub. No.: WO2018/013095
PCT Pub. Date: Jan. 18, 2018

(65) Prior Publication Data
US 2019/0203571 A1 Jul. 4, 2019

(51) Int. Cl.
*E21B 33/035* (2006.01)
*E21B 34/02* (2006.01)
(Continued)

(52) U.S. Cl.
CPC ..... *E21B 43/126* (2013.01); *E21B 33/035* (2013.01); *E21B 34/02* (2013.01); *E21B 43/01* (2013.01); *E21B 43/128* (2013.01)

(58) Field of Classification Search
CPC ..... E21B 33/03; E21B 33/035; E21B 33/04; E21B 33/043; E21B 33/068;
(Continued)

(56) References Cited

U.S. PATENT DOCUMENTS 4,391,330 A 7/1983 Kiefer
6,776,230 B2 * 8/2004 Collie ..... E21B 33/043 166/337
(Continued)

FOREIGN PATENT DOCUMENTS

GB 2203062 A 10/1988
GB 2494317 A 3/2013
(Continued)

OTHER PUBLICATIONS

International Search Report and Written Opinion dated Feb. 13, 2017 for PCT/US2016/041970.
(Continued)

*Primary Examiner* — Matthew R Buck
(74) *Attorney, Agent, or Firm* — Amerson Law Firm, PLLC

(57) ABSTRACT

Disclosed is a system for installing an ESP on a well. In one example the system comprises a production tree (12, 50) that is operatively coupled to a well (14), an ESP spool (16) that is operatively coupled to the production tree and production tubing (60) that extends into the well. The system also comprises an ESP (22) positioned within an inside diameter of the production tubing (60), wherein the ESP (22) comprises an electric motor (22M) and a pump (22P), the electric motor (22M) being positioned above the pump (22P), and wherein the pump (22P) comprises a fluid inlet (22X) and a fluid outlet (22Y). The system is installed above the existing down hole safety valve, and requires no modification to the existing well's completion equipment.

17 Claims, 5 Drawing Sheets

(51) Int. Cl.
*E21B 43/01* (2006.01)
*E21B 43/12* (2006.01)

(58) Field of Classification Search
CPC ..... E21B 33/076; E21B 34/02; E21B 34/04; E21B 43/126; E21B 43/128
See application file for complete search history.

(56) References Cited

U.S. PATENT DOCUMENTS

| | | | | |
|---|---|---|---|---|
| 7,640,993 | B2 | 1/2010 | Head | |
| 7,677,320 | B2 | 3/2010 | Shaw et al. | |
| 7,730,937 | B2 | 6/2010 | Head | |
| 7,753,129 | B2 | 7/2010 | Head | |
| 8,381,820 | B2 | 2/2013 | Martinez | |
| 8,534,366 | B2 | 9/2013 | Fielder et al. | |
| 8,746,354 | B2 | 6/2014 | Head | |
| 8,950,476 | B2 | 2/2015 | Head | |
| 9,028,264 | B2 | 5/2015 | Head | |
| 9,470,069 | B2 * | 10/2016 | Stubbeman | E21B 33/076 |
| 9,702,212 | B2 * | 7/2017 | Breda | E21B 33/035 |
| 9,896,897 | B2 * | 2/2018 | Brown | E21B 33/043 |
| 2013/0105156 | A1 * | 5/2013 | Bara | F04D 13/10 166/272.3 |
| 2014/0020907 | A1 | 1/2014 | Head | |
| 2014/0048277 | A1 | 2/2014 | June et al. | |
| 2015/0027686 | A1 * | 1/2015 | Hao | F01C 21/108 166/68 |
| 2015/0068769 | A1 | 3/2015 | Xiao et al. | |
| 2016/0002997 | A1 | 1/2016 | Farias et al. | |

FOREIGN PATENT DOCUMENTS

| | | | |
|---|---|---|---|
| GB | 2487875 | B | 4/2013 |
| GB | 2504102 | A | 1/2014 |
| GB | 2519737 | A | 5/2015 |
| WO | 2011/059925 | A2 | 5/2011 |
| WO | 2012/045771 | A2 | 4/2012 |

OTHER PUBLICATIONS

International Preliminary Report on Patentability dated Jun. 29, 2018 for PCT/US2016/041970.

* cited by examiner

SYSTEM FOR INSTALLING AN ELECTRICALLY SUBMERSIBLE PUMP ON A WELL

FIELD OF INVENTION

The present invention generally relates to motors, compressors and pumps that may be used in, for example, the oil and gas industry and, more particularly, to a unique system for installing an electrically submersible pump (ESP) on a well, such as a subsea well.

BACKGROUND OF THE INVENTION

Production trees (sometimes referred to as Christmas trees) are typically positioned on a well, both subsea and surface wells, to control the production of hydrocarbon fluids from the well. Such production trees typically include several valves that are selectively actuated to control production of hydrocarbon fluids from the well and to allow access to the well for certain remedial operations, such as injecting chemical into the well, monitoring conditions within the well, relieving pressure from within the well, etc. The production trees are typically classified as either vertical trees or horizontal trees. In a vertical tree, the primary production path is positioned vertically above the wellhead and various valves, e.g., a master valve, a swab valve, are positioned within this vertical production path to control the production of hydrocarbon fluids. In contrast, in a horizontal tree, there are no valves in the vertical bore wherein the hydrocarbon fluids produced are diverted horizontally within the tree to various valves outboard of the vertical bore.

After a well is drilled, certain activities and certain equipment must be installed in the well—i.e., the well must be completed—before production operations can begin. In general, the completion of a well may involve activities such as perforating the well, installing production tubing within the well, installing packers within the well, etc., wherein all of this installed equipment may generally be referred to as the "completion." Importantly, the well completion is designed and tailored based upon the known parameters of the well, such as the internal formation pressure, at the time the completion is made as well as the anticipated changes in the parameters of the well over the anticipated life of the well. For various reasons, the internal formation pressure of a well may decrease over time as hydrocarbon fluid is continuously produced from the well. In some cases, a well may be shut-in or abandoned if the natural formation pressure falls to a low enough level such that the well no longer produces hydrocarbon fluid at a rate that makes the well economically viable.

In some cases, an electrically submersible pump (ESP) is installed in wells to increase the production of hydrocarbon fluid from a well. In general, an ESP is an "artificial lift" mechanism that is typically positioned relatively deep within the well were it is used to pump the hydrocarbon fluid to the surface. However, installation of an ESP on an existing well can be very expensive for several reasons. First, installation of an ESP on an existing well requires that the completion be pulled and replaced with a completion that is designed for and includes the ESP. Second, such workover operations require the use of expensive vessels (e.g., ships or rigs) to re-complete the well, given the equipment that must be removed from the well during these workover operations. Even in the case where the well initially included an ESP, or where one was later added to the well, such ESPs do malfunction and have to be replaced. Thus, even in this latter situation, expensive vessels must be employed in replacing previously-installed ESPs.

The present application is directed to a unique system for installing an electrically submersible pump (ESP) on a well, such as a subsea well, that may eliminate or at least minimize some of the problems noted above.

BRIEF DESCRIPTION OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present application is generally directed to a unique system for installing an electrically submersible pump (ESP) on a well, such as a subsea well. In one example, the system comprises, among other things, a production tree that is operatively coupled to a well, an ESP spool that is operatively coupled to the production tree and production tubing that extends into the well. The system also comprises an ESP positioned within an inside diameter of the production tubing, wherein the ESP comprises an electric motor and a pump, the electric motor being positioned above the pump, and wherein the pump comprises a fluid inlet and a fluid outlet.

BRIEF DESCRIPTION OF THE DRAWINGS

The present invention will be described with the accompanying drawings, which represent a schematic but not limiting its scope.

Figure 1:
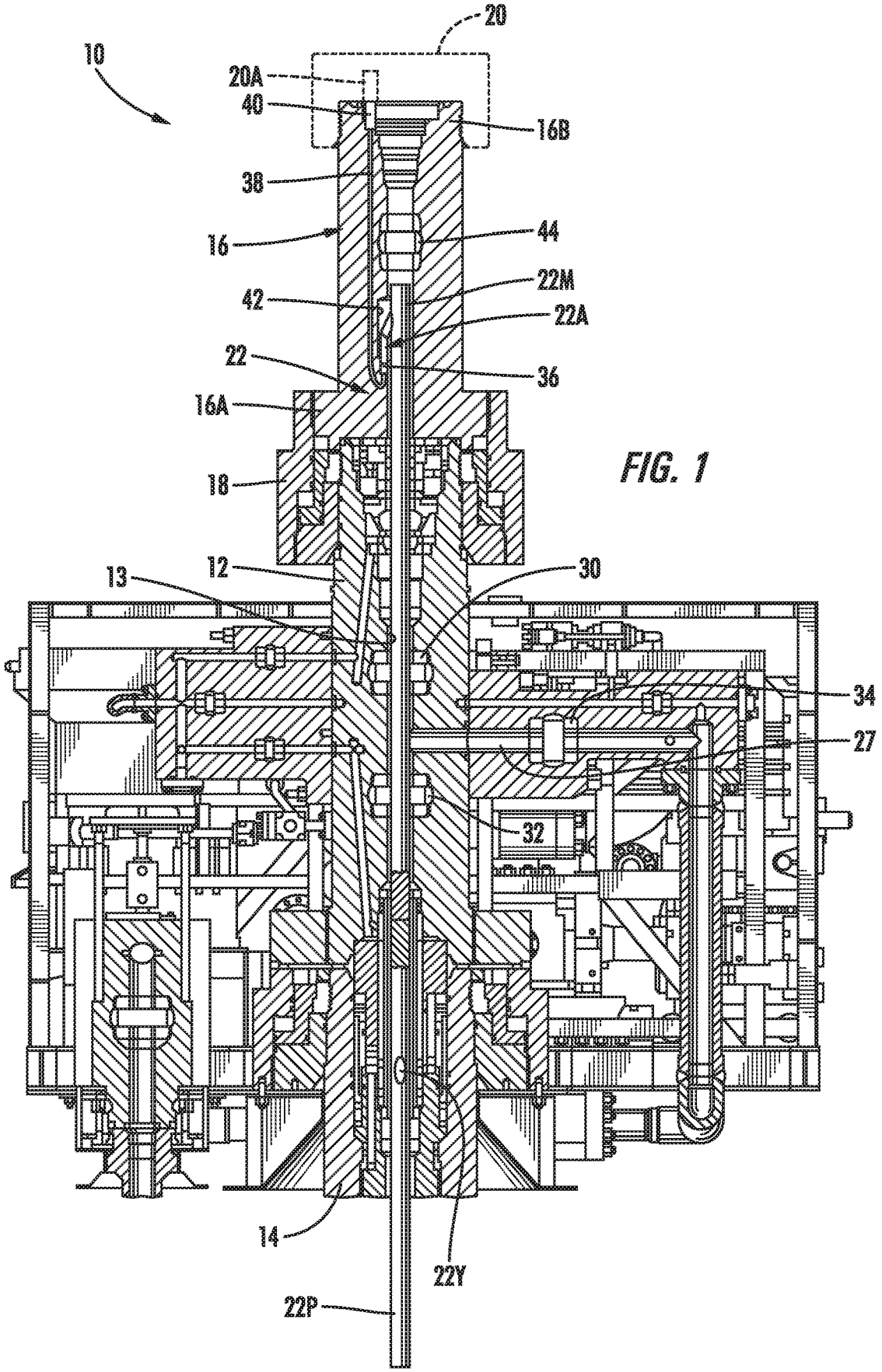
FIGS. 1-4 depict various embodiments and examples of the systems disclosed herein for installing an electrically submersible pump (ESP) on a well.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
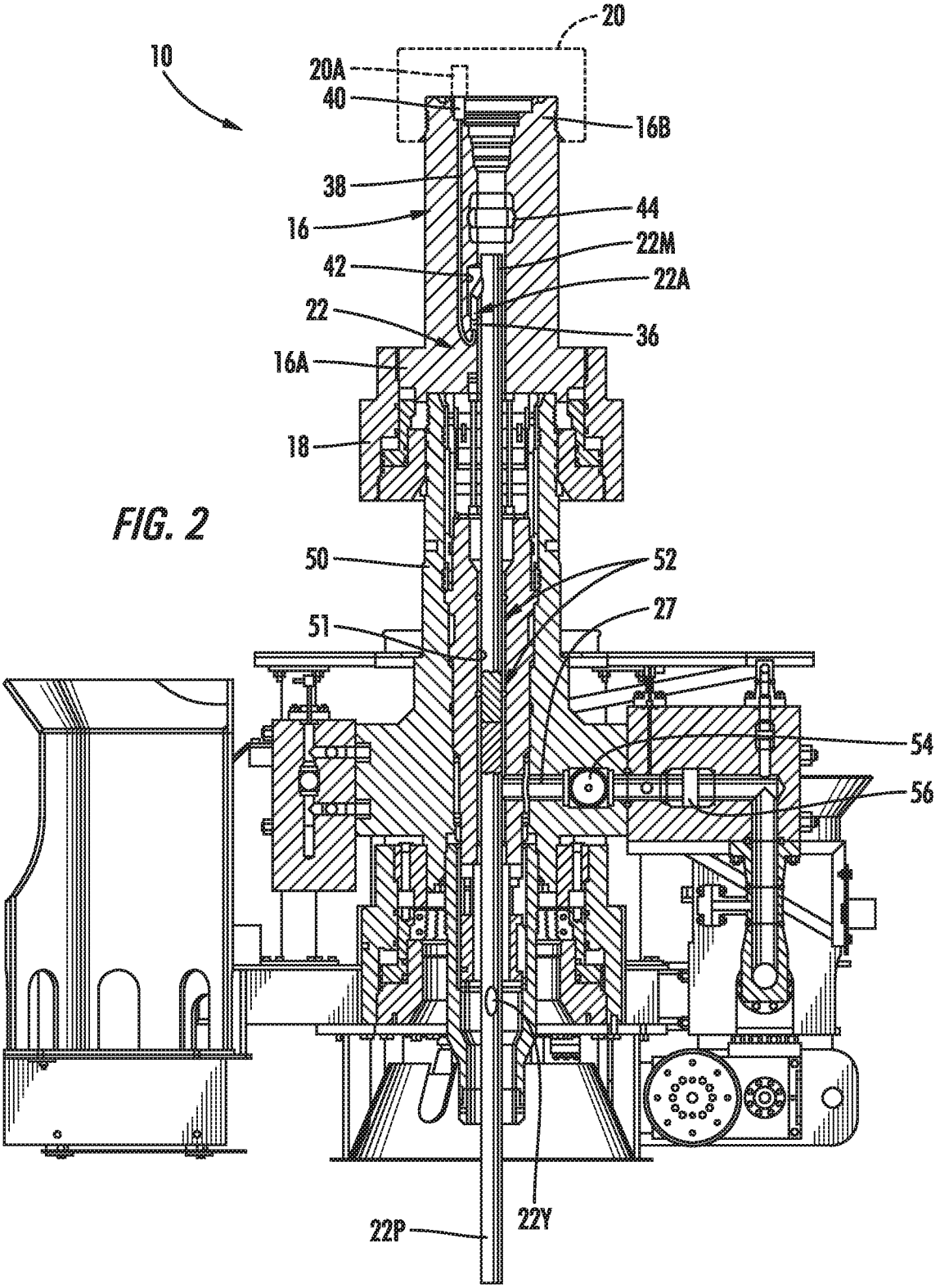

FIG. 1 depicts one illustrative embodiment of a system 10 disclosed herein that is employed in connection with a vertical production tree 12. FIG. 2 depicts another illustrative embodiment of a system disclosed herein that is employed in connection with a horizontal production tree 50. As shown in FIGS. 1 and 2, the trees 12, 50 are positioned above and coupled to an illustrative well head 14 (see FIG. 1). The system includes an ESP spool 16 that is operatively coupled to the tree 12, 50 by a hydraulically actuated connector 18 that, when actuated, secures the ESP spool 16 to the tree 12, 50. The system 10 further comprises a schematically and simplistically depicted ESP 22 with a motor 22M and a pump section 22P. Also depicted in dashed lines is an illustrative external tree cap 20, a valve 44 positioned within the ESP spool 16 above the ESP 22, a lower first wet mateable connector 36, an upper second wet mateable connector 40 and an electrical feed system 38 that may extend through or be part of the tree cap 20 or be incorporated into a portion of the ESP spool 16. The tree cap 20 comprises a wet mateable electrical connector 20A that is adapted to be operatively coupled to the wet mateable connector 40. The motor 22M further comprises a wet mateable electrical connector 22A that is adapted to be operatively coupled to the wet mateable connector 36. The ESP spool 16 comprises an inner body 16A with an upper flange or hub 16B. As noted above, in the depicted example, the inner body 16A of the ESP spool 16 is directly coupled to (and seals to) the production trees 12, 50 by the connector 18. However, in some application, one or more pieces of equipment (not shown) such as another spool, may be positioned above the ESP spool 16 and the production tree 12, 50. In either situation—direct coupling or coupling via an intermediate structure—the ESP spool 16 is operatively coupled to the production tree 12, 50. The valve 44 may be of any desired configuration, e.g., a gate valve, a full-diameter ball valve, etc.

With continuing reference to FIG. 1, the ESP 22 extends through a vertical bore 13 in the vertical tree 12. In this embodiment, the valves 30, 32 positioned in the internal vertically oriented bore 13 of the vertical tree 12 are opened to allow the ESP 22 to extend through the bore 13. As described more fully below, the pump portion 22P of the ESP will be positioned in the well at a location that is above the location of a subsea safety valve 64 (see FIG. 3) installed within the well. With reference to FIG. 2, the ESP 22 is positioned within a vertical bore 51 of the horizontal tree 50. In this embodiment, upper and lower crown plugs (not shown) have been removed from their former positions within the bore 51, as indicated by the arrows 52, to allow a portion of the ESP 22 to be positioned within the bore 51.

Figure 3:
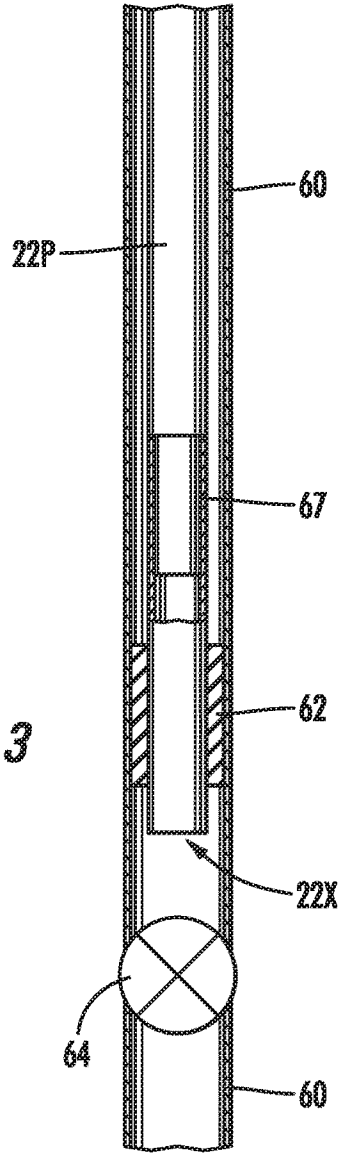

With reference to FIG. 3, the ESP 22 will be positioned within the tree 12, 50 such that an inlet 22X to the pump section 22P of the ESP 22 is positioned within the well at a location that is above the location of the subsea safety valve 64. More specifically, the pump section 22P may be positioned within the production tubing 60 and extend through a packer 62 positioned within the production tubing 60.

Figure 4:
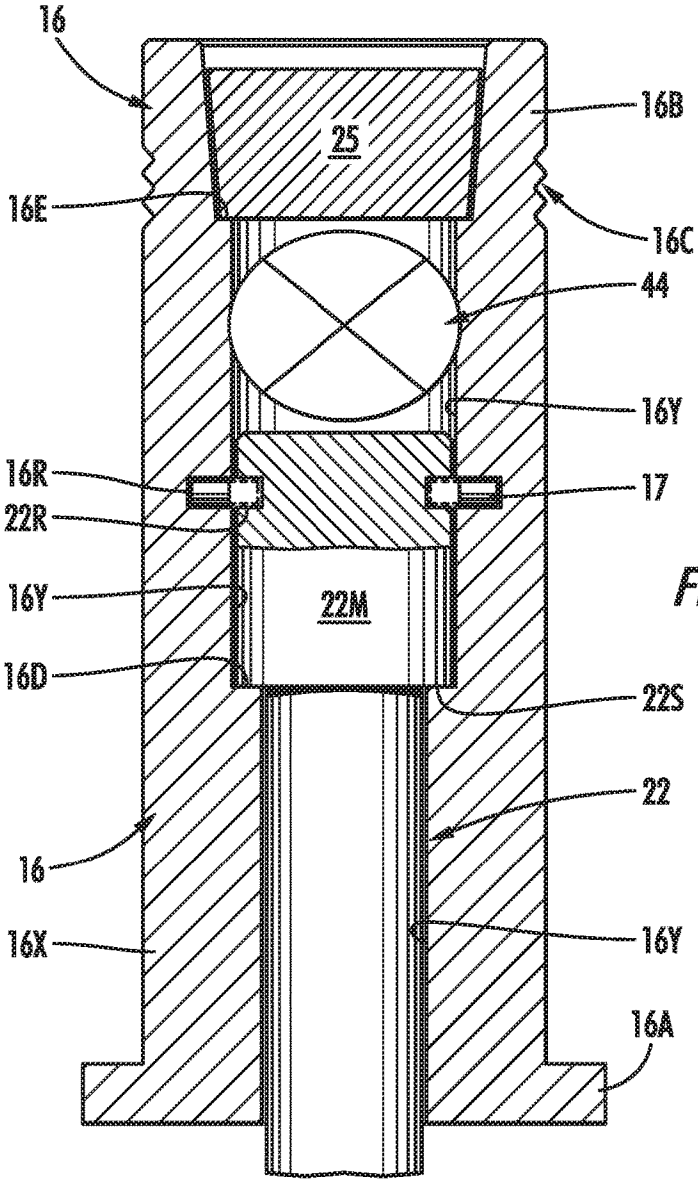

FIG. 4 is a simplistic cross-sectional view of portions of one illustrative embodiment of the ESP spool 16 disclosed herein. The ESP spool 16 comprises a body 16X and a bore 16Y that extends through the body 16X. In this particular example, the ESP spool has a profile 16C that is adapted to be engaged by any of a variety of different items of equipment, e.g., a subsea lubricator, a riser-less work over package, BOP stack, etc. The upper hub 16B of the ESP spool 16 may be of any desired size. In one illustrative embodiment, the profile 16C may be an industry standard profile to facilitate the attachment of equipment to the ESP spool 16. Also depicted in FIG. 4 is an illustrative internal tree cap 25 that is positioned within the ESP spool 16. The internal tree cap 25 lands on a shoulder 16E defined in the ESP spool 16. The internal tree cap 25 may be secured within the ESP spool 16 using any of a variety of known techniques. The ESP spool 16 may also be configured with a valve 44 or another form of a pressure barrier that can be operably removed and installed or in the case of a valve opened or closed to permit passage of ESP for installation or retrieval operations.

FIG. 4 also depicts an illustrative embodiment, wherein the ESP 22, and particularly, as least a portion of the ESP motor 22M is secured within the ESP spool 16 by schematically depicted retaining dogs or clamps 17 that are positioned in a recess 16R defined in the body 16X of the ESP spool 16. When the clamps are actuated they engage a recess 22R defined in the ESP 22. The retaining clamps 17 may be of any desired construction and configuration, e.g., one or more partial ring segments, a plurality of individual elements, etc. The retaining clamps 17 they me be spring-loaded or hydraulically actuatable. The engaged position of the clamps 17 with the recesses 22R is depicted in dashed lines in FIG. 4. The ESP 22 has a shoulder 22S that lands on a shoulder 16D defined in the ESP spool 16. The axial length of the ESP spool 16 may vary depending upon the particular application. The valve 44 disposed in the bore 16Y above the ESP 22 is closed when the ESP 22 is in operation. The closed valve 44 provides one of two pressure barriers to the environment. This pressure barrier could be any number of devices, i.e. plug, ball valve, etc., provided the pressure barrier provides isolation of the production fluids from the environment.

With reference to FIGS. 1-3, in one illustrative embodiment, the ESP 22 comprises a schematically and simplistically depicted fluid outlet 22Y. The pump outlet 22Y may be positioned at any location above the packer 62 and below the motor 22M. In the depicted example, the pump outlet 22Y is located below the horizontally-oriented production outlet 27 in the trees 12, 50 where produced hydrocarbon fluids will flow during operation. As will be appreciated by those skilled in the art after a complete reading of the present application, the ESP 22 depicted herein is an inverted ESP in that the motor 22M is positioned vertically above the pump 22P of the ESP 22. The size of the motor 22M and the pump 22P of the ESP 22 disclosed herein may vary depending upon the particular application. The motor 22M may be an AC or DC motor of any desired power rating and speed rating. The pump 22P of the ESP 22 may be of any desired configuration, e.g., a centrifugal pump with any desired number of stages. The materials of construction of the ESP 22 may vary depending upon the particular application.

Figure 5C:
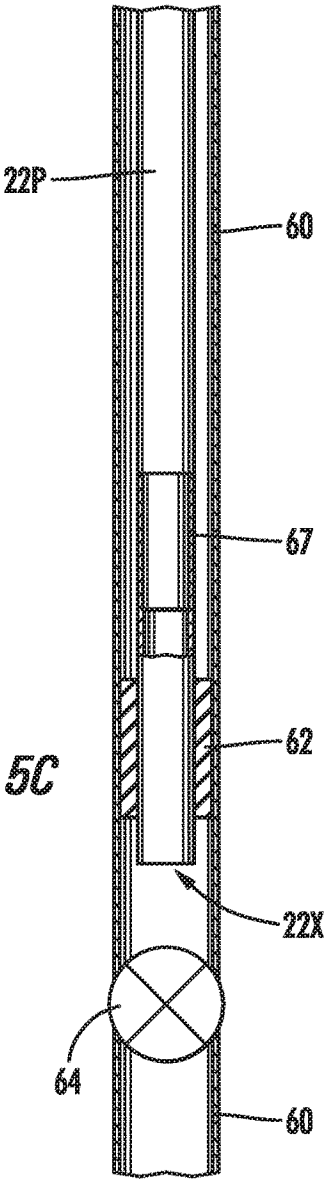
FIGS. 5A-5C depicts one illustrative technique for installing the ESP disclosed herein in a well.
Figure 5B:
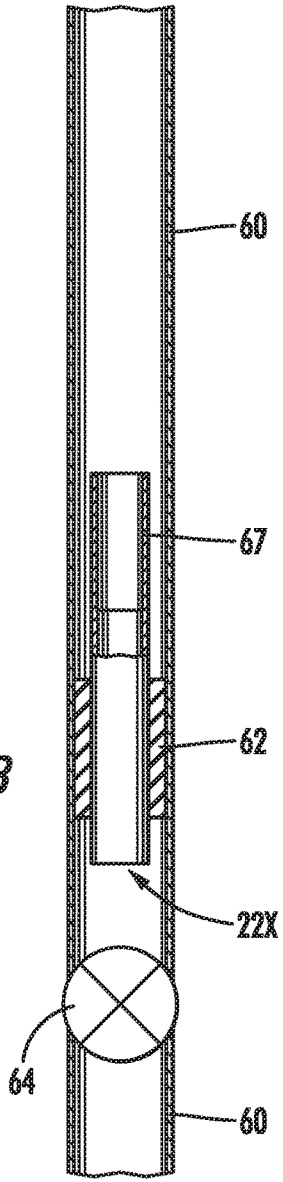
Figure 5A:
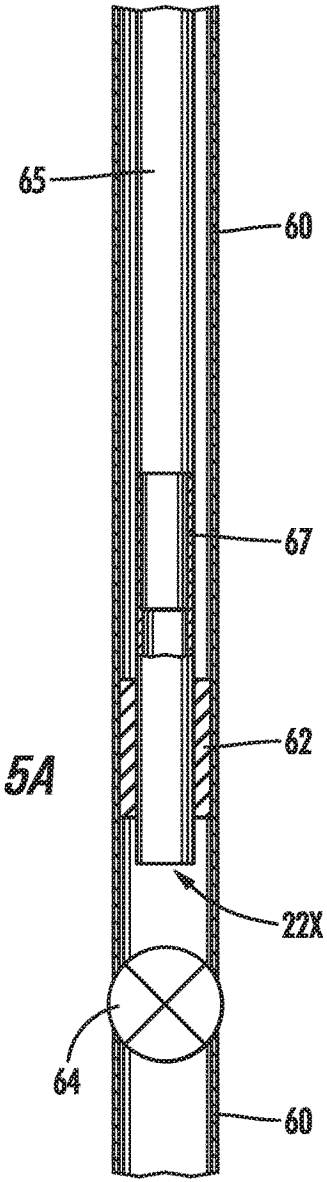

The ESP 22 may be installed using any of a variety of techniques. In one illustrative embodiment, the ESP spool 16 may be lowered to the well via a downline (such as a wireline) or other means and thereafter operatively coupled to the production tree 12, 50 via actuation of the connector 18. At that point, a lubricator (not shown) or a riser-less workover package (not shown) may be operatively coupled to the upper hub 16B of the ESP spool 16. In one embodiment, the packer 62 may then be installed in the production tubing 60 at a location above the safety valve 64. One illustrative technique for installing the packer 62 will be further described with reference to FIGS. 5A-5C. As shown in FIG. 5A, the packer 62 may be coupled to a "dummy" ESP structure 65 and run into the well until the packer 62 is positioned at the desired location in the production tubing 60. Thereafter, the packer 62 may be set in the production tubing 60 using known techniques, and the dummy ESP structure 65 may be decoupled from the packer 62 and recovered to the surface. The dummy ESP structure 65 may be a structure that has dimensions corresponding to that of the ESP 22 but it is of lighter weight construction and easier to handle. The packer 62 is but one example of a means of creating a barrier to isolate fluid within the production tubing from the pump inlet 22X and the pump outlet 22Y. A polished bore receptacle (PBR) 67, could be utilized either with or without a packer 62 to provide an appropriate sealing surface, such that a stinger and/or telescoping joint attached to the ESP pump inlet 22X could then interface with the PBR 67 to isolate the fluid communication from the ESP pump inlet 22X and the ESP pump outlet 22Y. As shown in FIG. 5B, the packer 62 may be installed with the PBR 67 prior to installing the ESP assembly in the production tubing 60 in whole or in part. Next, as shown in FIG. 5C, at least the pump portion 22P of the ESP 22 may be run into the well and coupled to the PBR 67 using, for example, an ESP running tool (not shown). In some cases, the entire ESP 22 including the motor 22M and the pump 22P may be run into the well at the point depicted in FIG. 5C. With reference to FIG. 4, in one illustrative embodiment, the complete ESP assembly 22, including the motor 22M and pump 22P, may be run into the well until the pump 22P engages the PBR 67 (see FIGS. 5B-5C) and the shoulder 22S on the ESP 22 engages the shoulder 16D in the ESP spool 16. At that point, the clamps 17 (or other similar devices) may be actuated so as to secure the ESP 22 in its operating position.

Figure 6:
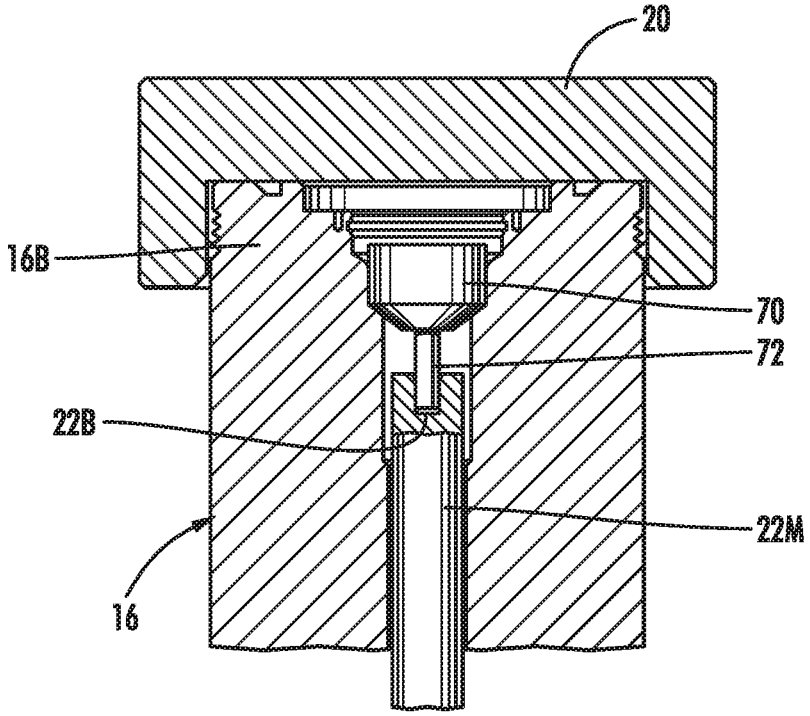
FIG. 6 depicts yet another illustrative technique for providing electrical power to an illustrative ESP disclosed herein.

Alternatively, the ESP 22 may be secured to the ESP spool 16 using an illustrative electrical plug 70 shown in FIG. 6. The electrical plug 70 may be secured to the ESP spool 16 and can function as a means of a primary pressure barrier, eliminating the need for another pressure barrier, such as the valve 44 shown in FIG. 4. In this example, the electrical plug 70 serves as both a means to secure the ESP 22 as well as provide means of supply electrical power to the ESP motor 22M. In other embodiment, the electrical plug 70 could be configured to provide a secondary pressure barrier in addition to providing a primary pressure barrier. By doing so the need for an external tree cap could be eliminated. Electrical power is supplied to the electrical plug via wet mate electrical connection on the electrical plug (not shown). A lock mechanism that is incorporated into the ESP assembly 22 is yet another example of a means for securing the ESP 22 to the ESP spool 16. Such a lock mechanism could be actuated by an ESP running tool (not shown). In one example, such a lock mechanism may be similar to the mechanism used to secure tubing hangers to wellheads, tubing heads or production tree equipment.

The external tree cap 20 (see FIG. 1) or the internal tree cap 25 (see FIG. 4) may be operatively coupled to the ESP spool 16. The internal tree cap 25 may be operatively coupled to the ESP spool 16 while the lubricator/work over package is coupled to the ESP spool 16. The external tree cap 20 may be coupled to the ESP spool 16 using an ROV after the lubricator/work over package is disengaged from the ESP spool 16. The use of either an internal or external tree cap provides a second pressure barrier to the environment for the production bore fluids. Alternately, the internal tree cap 25 could be replaced by any other means of isolating production fluids from the environment, i.e. ball valve, gate valve, etc., which could be integral to the ESP spool 16 located above the primary pressure barrier 44 in the ESP spool 16.

As will be appreciated by those skilled in the art after a complete reading of the present application, the presently disclosed invention provides a means by which an ESP 22 may be installed on a well without having to remove the well completion to reconfigure it for use with an ESP. Moreover, the ESP 22 disclosed herein may be installed by performing wireline operations from a riserless lightweight intervention vessel, all of which result in significant cost savings as compared to prior art techniques involving the use of a Mobile Offshore Drilling Unit (MODU) for pulling the well completion, reconfiguring the well completion for downhole ESP use, and installing an ESP within the well. Additionally, the system disclosed herein may even be employed in eases where an ESP was installed deep in the well but has failed. In that situation, rather than pull the completion to replace the failed ESP, the ESP 22 disclosed herein may simply be installed while leaving the faded ESP positioned below the SCSSV within the well, provided that there is adequate means of establishing flow around the failed ESP. Using the methods and techniques disclosed herein, the valve 44 positioned in the ESP spool 16 and the tree cap 20 or 25 provide the required two pressure barriers during operations.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A system, comprising:

a production tree that is operatively coupled to a well head of a well;

an Electrically Submersible Pump (ESP) spool that is operatively coupled to the production tree;

production tubing extending into the well; and an Electrically Submersible Pump (ESP) comprising an electric motor and a pump, the electric motor being positioned above the well head and the pump being positioned below the electric motor and within an inside diameter of the production tubing, the pump comprising a fluid inlet that is adapted to receive a flow of fluid from the production tubing and a fluid outlet that is adapted to discharge said flow of fluid to an annular space defined within the production tubing between the ESP and the inside diameter of the production tubing.

2. The system of claim 1, wherein at least a portion of the electric motor is positioned within the ESP spool.

3. The system of claim 1, wherein the production tree comprises a vertically oriented bore and wherein the ESP extends through the vertically oriented bore and into the well.

4. The system of claim 1, further comprising a first pressure barrier positioned in the ESP spool above the ESP.

5. The system of claim 4, wherein the first pressure barrier comprises a valve positioned in the ESP spool above the ESP.

6. The system of claim 5, wherein the valve comprises one of a gate valve or a ball valve and wherein the valve is adapted to be closed when the ESP is in operation.

7. The system of claim 4, further comprising an external tree cap that is coupled to the ESP spool at a position above the first pressure barrier.

8. The system of claim 1, wherein the ESP spool comprises a shoulder that is adapted to engage a shoulder on the ESP and wherein the system further comprises an electrical plug installed in the ESP spool that is adapted to be electrically coupled to the electric motor of the ESP.

9. The system of claim 8, further comprising an actuatable clamp that is adapted to engage a recess on the ESP to secure the ESP to the ESP spool.

10. The system of claim 8, wherein the electrical plug comprises a first pressure barrier and wherein the system further comprises an external tree cap that connects to the electrical plug to provide power to the ESP.

11. The system of claim 1, further comprising a first wet mateable electrical connector positioned in the ESP spool that is adapted to engage a second wet mateable electrical connector on the electric motor so as to provide power to the ESP motor.

12. The system of claim 1 wherein the electric motor further comprises one half of a wet mateable connector.

13. The system of claim 1, further comprising:

an external tree cap that is coupled to the ESP spool;

an electrical wet mateable connector on the tree cap; and an electrical wet mateable connector on the ESP spool that is electrically coupled to the electrical wet mateable connector on the tree cap so as to thereby permit transmission of electrical power to the ESP.

14. The system of claim 1, wherein the ESP spool is deployable using a downline or a wireline.

15. The system of claim 1, further comprising an isolation barrier positioned in the annular space between a portion of the ESP and the inside diameter of the production tubing at a location above the pump fluid inlet and below the pump fluid outlet, wherein the isolation barrier is adapted to prevent said flow of fluid received by the pump fluid inlet from the production tubing below the isolation barrier and discharged from the pump fluid outlet to the annular space above the isolation barrier from flowing back into the production tubing below the isolation barrier.

16. The system of claim 1, wherein the pump fluid outlet is positioned within the well head.

17. The system of claim 4, further comprising an internal tree cap that is positioned within and coupled to the ESP spool at a position above the first pressure barrier.

* * * * *